US008499818B2

(12) United States Patent
Grozdanich et al.

(10) Patent No.: US 8,499,818 B2
(45) Date of Patent: Aug. 6, 2013

(54) ENCAPSULATED SOLID CERAMIC ELEMENT

(75) Inventors: Rod Alan Grozdanich, Liberty Lake, WA (US); Edward Robert Kaczmarek, Spokane, WA (US)

(73) Assignee: Spokane Industries, Spokane, WA (US)

( * ) Notice: Subject to any disclaimer, the term of this patent is extended or adjusted under 35 U.S.C. 154(b) by 0 days.

(21) Appl. No.: 13/192,174

(22) Filed: Jul. 27, 2011

(65) Prior Publication Data

US 2013/0025440 A1 Jan. 31, 2013

(51) Int. Cl.
*B22D 19/00* (2006.01)
*B22D 19/02* (2006.01)

(52) U.S. Cl.
USPC ..... 164/98; 164/103; 164/105; 164/112

(58) Field of Classification Search
USPC ..... 164/98, 100, 103, 105, 112
See application file for complete search history.

(56) References Cited

U.S. PATENT DOCUMENTS 3,705,558 A 12/1972 McDougal et al.
6,112,635 A * 9/2000 Cohen ..... 89/36.02

OTHER PUBLICATIONS

"Aluminum encapsulated ceramic tiles for hybrid armor," retrieved on Jun. 27, 2011 at <<http://beforeitsnews.com/story/359/658/Aluminum_encapsulated_ceramic_tiles_for_hybrid_armor.html>>, Before Its News, Jan. 15, 2011, 4 pages.
"Aluminum encapsulated ceramic tiles for hybrid armor," retrieved on Jun. 27, 2011 at <<http://nextbigfuture.com/2011/01/aluminum-encapsulated-ceramic-tiles-for.html>>, Next Big Future, Jan. 15, 2011, 19 pages.
Coor Tek, "Ceramic Armor /Military Defense and Security," retrieved on Jul. 7, 2011 at <<http://www.coorstek.com/products/ceramic-armor.asp>>, 2 pages.
Coors Tek, "Advanced metallized Ceramics for Electronic Applications," retrieved on Jul. 7, 2011 at <<http://www. coorstek.com/resources/8510-1170AdvancedMetallizedCeramics2.pdf>>, 2 pages.
Coors Tek, "Ceramic Armor," retrieved on Jul. 7, 2011 at <<http://www.coorstek.com/resources/8510-1091_Ceramic_Armor.pdf>>, 4 pages.
Coors Tek, "Vacuum Bonding," retrieved on Jul. 7, 2011 at <<http://www.coorstek.com/resources/8510-1162VacuumBonding.pdf>>, 4 pages.
"The HybridTech Armor(R) Technology—Ballistic Armor," retrieved on Jun. 27, 2011 at <<http://www.alsic.com/HybrdTech-Technology.html>>, CPS Tecnologies 2011, 1 page.
ZYP Coatings, Inc., retrieved on Jul. 7, 2011 at <<http://www.zypcoatings.com/>>, 1 page.
Translated French patent pub No. 2711782; National registration No. 91 09675; filed Jul. 30, 1991; Inventors Cameo-Ponz, et al.; 5 pages.

* cited by examiner

*Primary Examiner* — Kevin P Kerns
(74) *Attorney, Agent, or Firm* — Lee & Hayes, PLLC

(57) ABSTRACT

A composite ballistic armor or other composite component may be formed by encapsulating one or more ceramic elements in a casting shell and introducing molten base metal into the casting shell, such that the molten base metal encapsulates the one or more ceramic elements to form the composite component. Prior to the pouring process, the ceramic elements are pre-heated to, or near, the melting point temperature or pouring temperature of the encapsulating metal. Additionally, the cooling rate following the metal pour may be less than a predetermined rate for a predetermined period of time. The encapsulating metal may comprise, for example, a steel alloy, such as 4140 or 8630 AISI, a stainless steel alloy, or FeMnAl.

21 Claims, 6 Drawing Sheets

ENCAPSULATED SOLID CERAMIC ELEMENT

BACKGROUND

Ballistic impact resistant components are desirable in a variety of industrial, commercial, and military applications.

Recently, composite components formed of multiple materials having different material properties have been used. For example, a composite component may be made by combining a first material having a high hardness with a second material having a high toughness, to produce a composite component having characteristics of both materials (i.e., high hardness and toughness).

However, manufacturing composite components is often challenging due to the different properties of materials used to form the composite components. For example, different materials often have different coefficients of thermal expansion, different densities, different melting points, etc. A manufacturing process that works well for one material may not be compatible with another material. For example, if two materials have different coefficients of thermal expansion, they will expand or contract at different rates. If the difference between coefficients of thermal expansion is significant, cracks and/or voids may form as a composite component made from the materials cools, thereby detracting from the performance of the composite material.

Thus, there remains a need to develop new composite materials and methods of manufacturing such composite materials.

BRIEF SUMMARY

This Brief Summary is provided to introduce simplified concepts relating to techniques for casting composite components including an encapsulating a ceramic material within a metal, which are further described below in the Detailed Description. This Summary is not intended to identify essential features of the claimed subject matter, nor is it intended for use in determining the scope of the claimed subject matter.

This disclosure relates to composite components comprising one or more solid ceramic elements cast in situ or otherwise encapsulated or partially encapsulated in a base metal, and techniques for forming such components. In some embodiments, such composite components may be configured to withstand or resist ballistic impacts. While in some examples, a single ceramic element may be encapsulated by a metal layer, in other examples, two or more ceramic elements may be arranged, for example, in an adjacent, subjacent, and/or overlapping manner in order to provide desired ballistic protection. Also, while the ceramic elements are shown to be completely encapsulated in the base metal, in other embodiments, the ceramic elements may be only partially encapsulated in the base metal. That is, in some embodiments, less than all of the ceramic element(s) may be covered by the base metal, such that a portion of one or more of the ceramic element(s) is exposed.

A relatively hard ceramic material may be integrated with a relatively tough encapsulating metal in a way that enables the composite material to exhibit ballistic resistant capabilities of both materials at the same time. Hence, successfully integrating or combining dissimilar materials provides characteristics that are not available with a single material alone. In short, we present herein methods and techniques of combining ceramics and metals that may not otherwise ordinarily occur.

In one example, a composite ballistic protection component may be produced using an investment casting process by forming a casting shell around a ceramic element encapsulated in a temporary pattern material, such as, for example, wax, gel, or foam. The pattern material may then be removed from the casting shell (e.g., by firing the casting shell to melt or vaporize the pattern material) to leave an air gap between the casting shell and the ceramic element. Prior to removing the pattern material, the ceramic element may be secured to the shell via screws, pins, wire frames, or other coupling or stabilizing devices.

Following the removal of the pattern material, the ceramic element may be preheated to a temperature of at least about 50% of the melting point or pouring temperature of an encapsulating metal. The pouring temperature is the temperature of the liquid metal as it is poured into the casting shell. In the case of steel, for example, the ceramic element may be preheated to at least about 1300 degrees Fahrenheit (F.). In some embodiments, the ceramic element may be preheated to at least about 75% of the melting point or pouring temperature of the encapsulating metal (e.g., at least about 1950 degrees F. for steel). In other embodiments, the ceramic element may be preheated to at least the melting point or pouring temperature of the encapsulating metal (e.g., at least about 2600 degrees F. for steel). In other embodiments, the ceramic element may be superheated relative to the melting or pouring temperature of the encapsulating metal. It may take more time to heat the ceramic element to the desired preheat temperature than it takes to heat the casting shell to the desired preheat temperature. Thus, the casting shell may be soaked at the desired temperature for a time sufficient for the ceramic element inside the casting shell to reach the desired preheat temperature. Additionally or alternatively, the casting shell may be heated above the desired preheat temperature of the ceramic element, in order to shorten the time required for the ceramic element to reach the desired preheat temperature.

Once a uniform preheat temperature is achieved across the ceramic element, the encapsulating metal may be poured into the casting shell enveloping the ceramic element. After an appropriate soaking time, the casting shell, metal, and ceramic element may be cooled at a slow rate for a specified period of time to form a composite component of one or more solid ceramic elements encapsulated in a base metal. As used herein, the term "slow rate" means a rate slower than a rate at which the component would air cool if placed in a location at standard temperature and pressure. The specific slow rate of cooling and the specified period of time depend on the specific combination of ceramic material and base metal, size and shape of the ceramic elements, and the desired material properties of the composite material. In some embodiments, the casting shell and composite component may be cooled at a continuous slow rate until it reaches a predetermined temperature (e.g., 50% of the pouring temperature, 20% of the pouring temperature, room temperature, etc.). Examples of continuous slow rates of cooling that may be used in various embodiments include rates at most about 300 degrees F. per hour, at most about 200 degrees F. per hour, at most about 150 degrees F. per hour, or at most about 100 degrees F. per hour.

In other embodiments, the casting shell and composite component may be cooled at a first rate for a first period of time, and at a second rate which is faster than the first rate for a second period of time. The first and second periods of time may be determined based on the temperature of the casting shell and composite component. For example, the first period of time may be a time required for the casting shell and composite component to reach a predetermined temperature (e.g., 75% of the pouring temperature, 50% of the pouring temperature, 20% of the pouring temperature, etc.), and the second time period may be the time period required for the casting shell and composite component to reach a second predetermined temperature (e.g., 50% of the pouring temperature, 20% of the pouring temperature, room temperature, etc.). In one specific example, during a first period of time the casting shell and composite component may be cooled at a rate of at most 100 degrees F. per hour until the casting shell and composite component reach 20% of the pouring temperature, and thereafter the casting shell and composite component may be cooled at a rate greater than 100 degrees F. per hour, but at most 300 degrees F. per hour until the casting shell and composite component reach room temperature.

In other examples various investment, sand, or other casting techniques may be used to produce components according to this disclosure.

The techniques described herein may be used singly or in combination, depending on the desired ballistic protection characteristics of the composite component. The techniques to encapsulate ceramic materials will be discussed further below in the Detailed Description.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
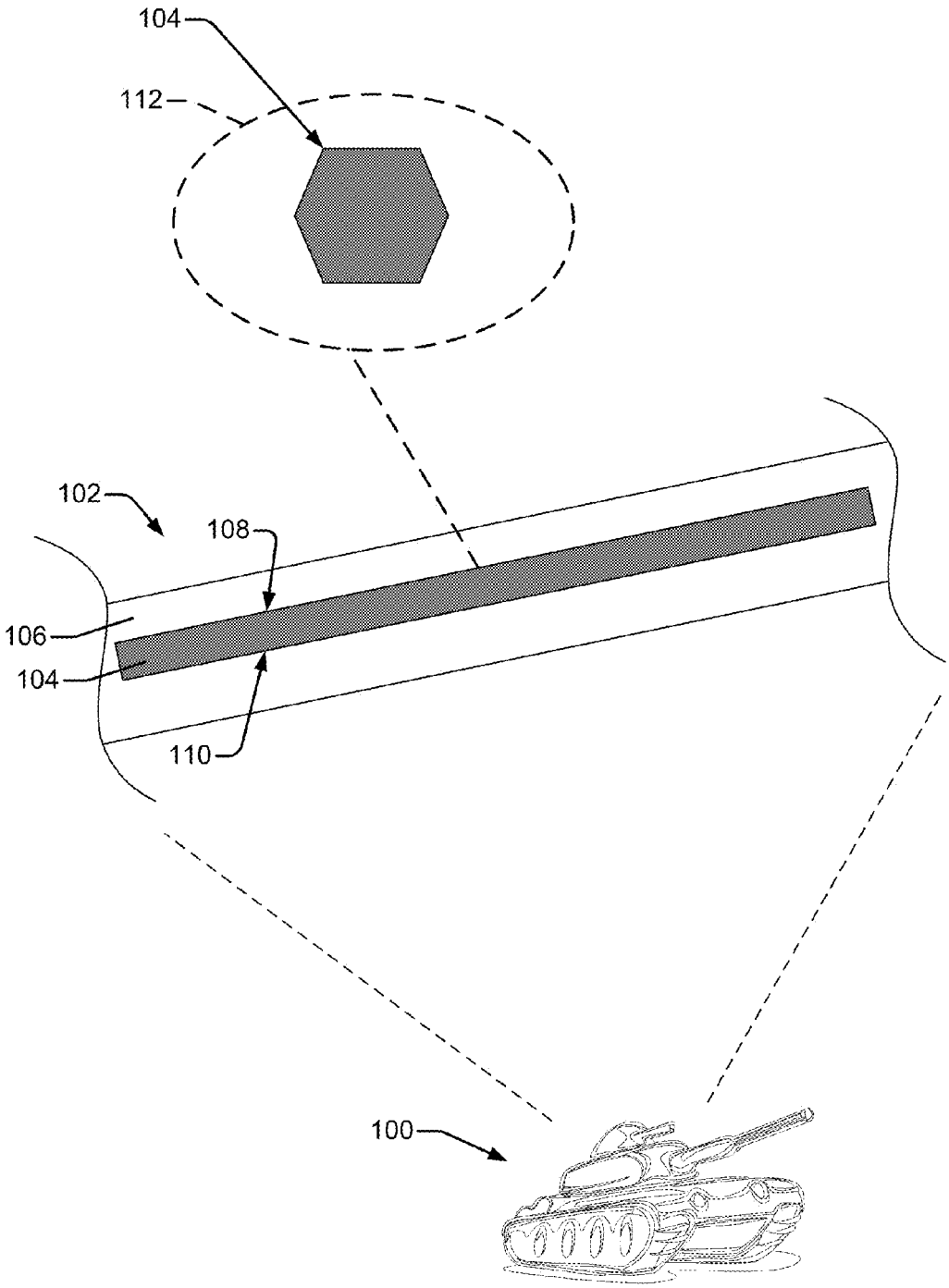
FIG. 1 is a diagram of a vehicle having an example composite ballistic armor comprising a ceramic element that is encapsulated by a metal layer.

As noted above, manufacturing of composite components is often difficult due to the varying material properties of the materials from which the composite component is made. This application describes composite components comprising ceramics and metal or metal alloy(s) that, together, exhibit improved resistance to impact compared with components formed of ceramic or metal alone. This application also describes various techniques for manufacturing such composite components. By way of example and not limitation, the composite components described herein may be used in the fields of military applications, excavation, manufacturing, metallurgy, milling, material handling, transportation, construction, and the like.

In general, composite components as described in this application include a one or more relatively hard ceramic elements encapsulated by a relatively tough metal. This application describes techniques for casting such composite components using investment casting techniques. However, as noted above, other casting techniques may also be used in other embodiments.

In some embodiments, the ceramic materials comprise, solid, substantially flat elements (e.g., sheets, plates, blocks, or tiles), of alumina, silicon carbide, or any other ceramic material, that are arranged in configurations of three or more sides (e.g., triangle, square, pentagon, hexagon, octagon, or any other polygonal shape). For example, the ceramic material may comprise one or more ceramic elements, each having a front side and back side, which are parallel to each other, and sidewalls, which are substantially perpendicular to the front and back sides. The thickness of the ceramic elements may vary depending on the specific application. In some examples, the ceramic elements may have a thickness of between about ½" and about 2 inches; however, in other examples, the thickness of the ceramic elements may be less than ½" or greater than 2". In a specific example, the ceramic elements may have a thickness of between about ¾" and about 1⅜". In some embodiments, the intersection of the front and/or back sides with the sidewalls may be rounded or chamfered.

Also, in some embodiments, the encapsulating metal layer on the front and back sides of the ceramic element may be at least about ⅛" thick. However, the metal layers on the front and back need not be the same. In one example, the encapsulating metal layer on one side of the ceramic element may be about ¼"-½" thick, while the encapsulating metal layer on the other side of the ceramic element may be at least about ½" thick. In a more specific example, the encapsulating metal layer on one side of the ceramic element may be about ¼" thick, while the encapsulating metal layer on the other side of the ceramic element may be about 1⅜" thick. However, in other embodiments, any other thickness of base metal may be used. Furthermore, the thickness on the front and/or back may be non-uniform. For example, the front and/or back surfaces may have one or more protruding or indenting features, such as ribs, ridges, grooves, channels, fins, quills, pyramids, mesh, nubs, dimples, or the like. The features may protrude or indent perpendicular to the respective surface or at an oblique angle relative to the respective surface.

The encapsulating metal may comprise a relatively tough steel alloy, such as FeMnAl, stainless steel, 4140 AISI steel, or 8630 AISI steel. As used herein, the term "steel" includes alloys of iron and carbon, which may or may not include other constituents such as, for example, manganese, aluminum, chromium, nickel, molybdenum, copper, tungsten, cobalt, and/or silicon. As used herein, the term FeMnAl includes any iron based alloy including at least about 3% manganese by weight, and at least about 1% aluminum by weight. In another specific example, high-chrome iron (or white iron) may be used as a base metal for an encapsulating metal. In other examples, still other base metals (e.g., titanium, etc.) may be used to encapsulate ceramic elements according to this disclosure.

Ranges of what is considered "relatively hard" and "relatively tough" may vary depending on the application, but in one example "relatively hard" materials are those having a Vickers Hardness of at least about HV=1300 (13 GPa) or a Knoop hardness of at least about HK=800 (2.7 GPa), and "relatively tough" materials are those having a an impact toughness of at least about 10 ft-lbs at −40 degrees F. and/or a tensile strength of at least about 80,000 psi in the "as cast,"

non-heat treated state. In some examples, relatively tough materials may have an impact toughness of at least about 20 ft-lbs at −40 degrees F. and/or a tensile strength of at least about 100,000 psi in the "as cast," non-heat treated state. To be clear, however, this disclosure is not limited to using materials having the foregoing ranges of hardness or toughness.

Also, while the ceramic element embodiments described herein employ alumina and/or silicon carbide, other ceramic materials may also be used for the ceramic elements such as, for example, zirconia, tungsten carbide, titanium carbide, boron carbide, zirconia-toughened alumina (ZTA), partially stabilized zirconia (PSZ) ceramic, silicon carbide, silicon oxides, aluminum oxides with carbides, titanium oxide, brown fused alumina, combinations of any of these, or the like.

In some embodiments, the ceramic elements may be coated with one or more barrier layers or coatings to prevent interaction or reaction between the ceramic elements and the molten metal during the casting process. The barrier layer(s) or coating(s) may comprise, for example, a refractory coating comprising zircon and fused silica, a zircon wash, a Nickel-based coating, a Yttrium Oxide coating, a Boron Nitride coating, or the like.

These and other aspects of the composite materials and components will be described in greater detail below with reference to several illustrative embodiments.

Example Composite Components Using Ceramics and Metal Alloys

This section describes an exemplary composite component formed by securing one or more ceramic elements in a mold and introducing a molten base metal into the mold, such that the molten base metal encapsulates the one or more ceramic elements to form the composite component.

In some implementations, the ceramic element(s) may be secured to the molds or casting shell to enable coating of all or part of the surface area of the ceramic element(s) with a metal layer. In this way, the encapsulating metal, when introduced into the mold, encapsulates, covers, or substantially covers the ceramic element(s). Composite components formed using this technique may be used for a variety of applications including, for example, as ballistic resistant armor for military vehicles or other industrial applications requiring impact protection. These and numerous other composite components can be formed according to the techniques described in this section.

Figure 2:
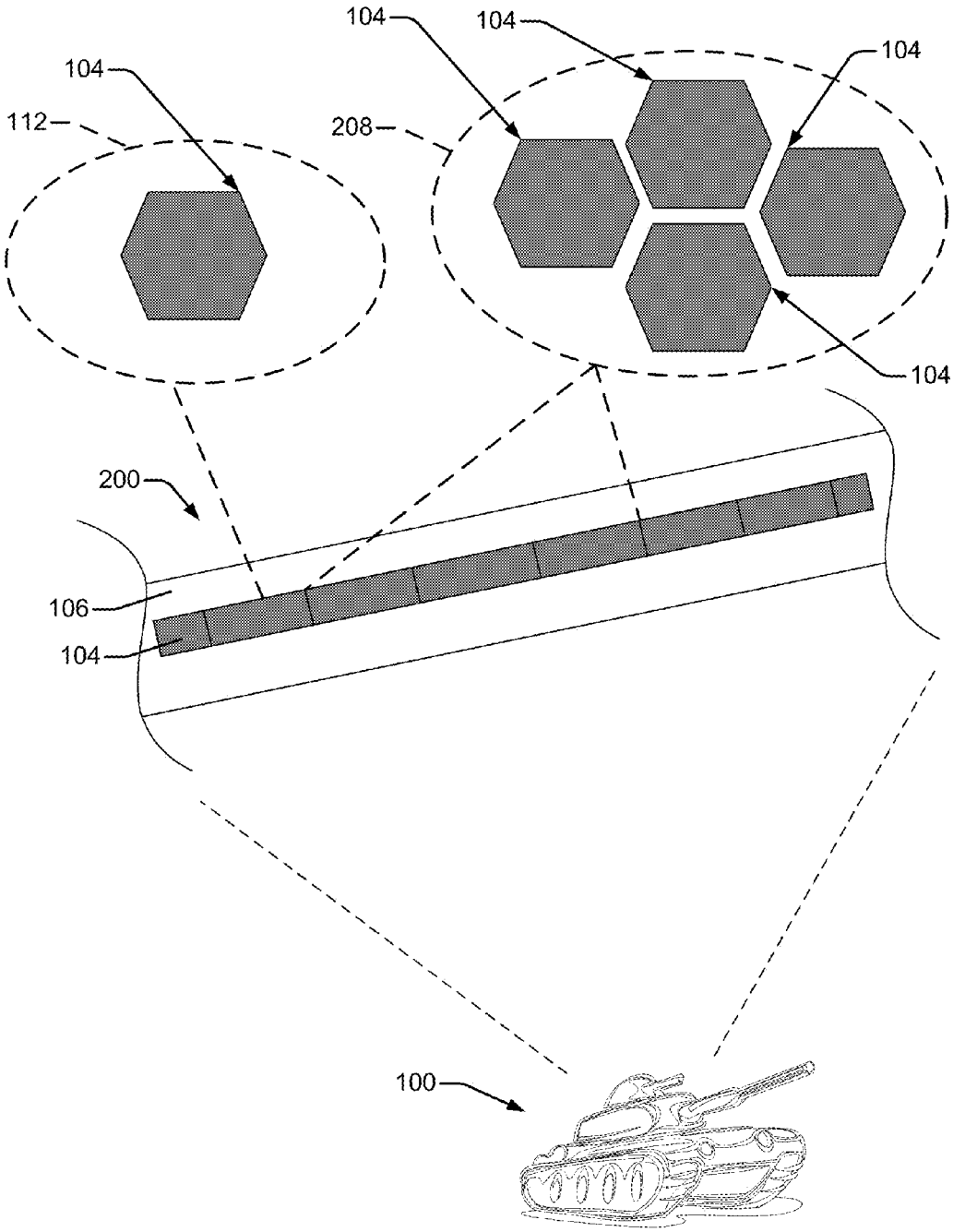
FIG. 2 is a diagram of a vehicle having an example composite ballistic armor comprising one or more ceramic elements that are encapsulated by a metal layer.
Figure 3:
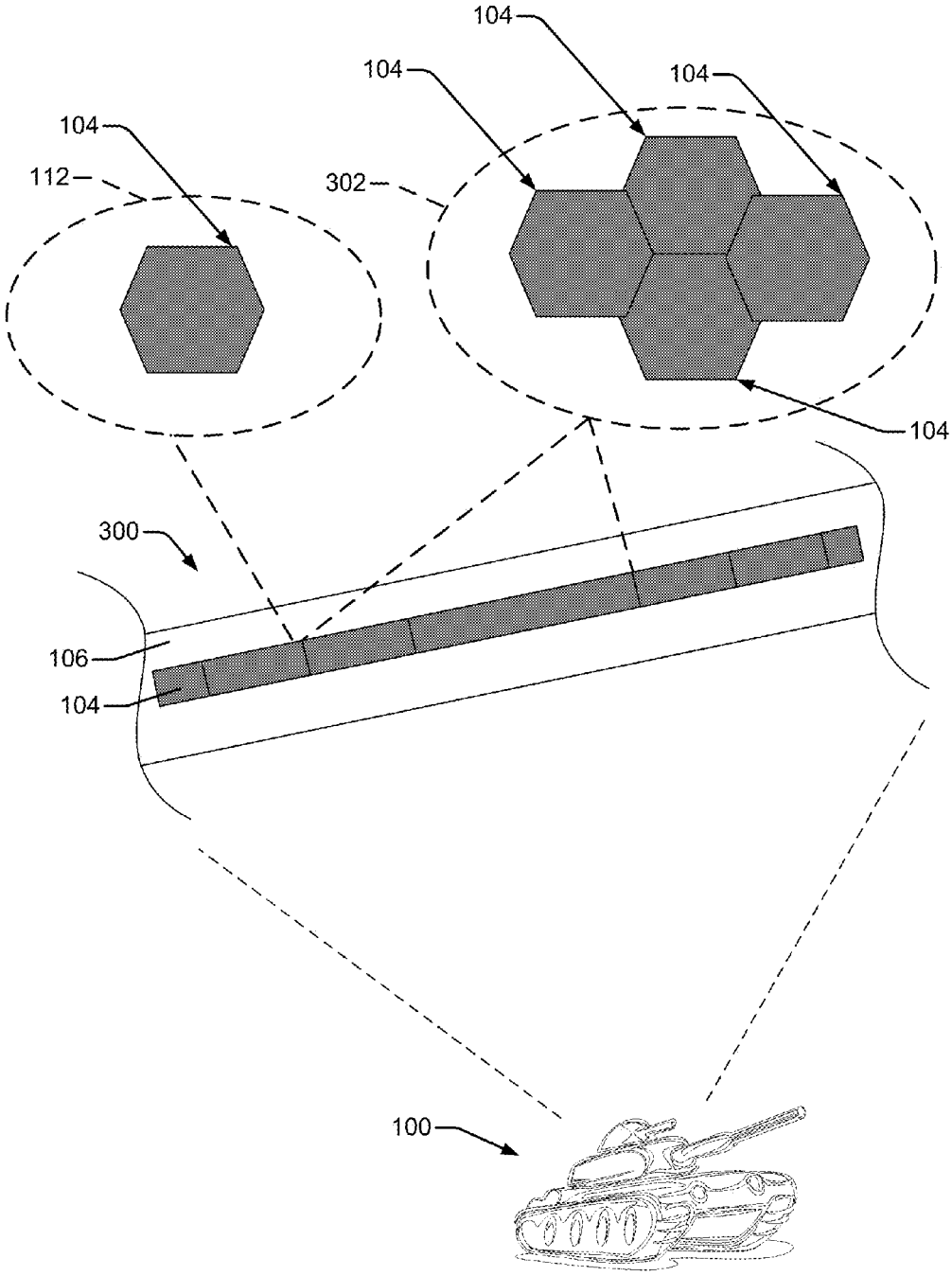
FIG. 3 is a diagram of a vehicle having another example composite ballistic armor comprising one or more ceramic elements that are encapsulated by a metal layer.

FIGS. 1-3 illustrate three embodiments of ceramic elements that may be used to form composite components, such as the composite ballistic armor described above.

FIG. 1 is a side view diagram of a composite component 102 used, for example, as ballistic armor on a vehicle 100. Metal/ceramic composite materials are well suited to ballistic-resistant applications due to the characteristics of the materials. For example, metals typically provide a relatively high strength-to-weight ratio and a high toughness, while ceramics have a relatively high hardness. Additionally, in part because the crack propagation speed of ceramics is below the speed of a ballistic projectile, ceramic materials provide extremely strong defense to ballistic impacts.

As shown in FIG. 1, the composite component 102 comprises a ceramic element 104 encapsulated in a metal alloy 106. As shown in the side view of the composite component 102, in this example, the front side 108 and the back side 110 are substantially parallel to each other. However, in other embodiments, the front and back sides 108, 110 of the composite component 102 need not be parallel and may be sloped or curved relative to one another. The geometry of the ceramic element 104 may vary widely depending on the application, requirements, geometry, or other characteristics of the composite component.

Generally, however, the ceramic elements are arranged to minimize space between ceramic elements or to achieve overlap between ceramic components. In one example, top view diagram 112 illustrates the ceramic element 104 comprising a hexagonal perimeter. However, in other examples, the ceramic elements 104 may have a perimeter with any number of three or more sides. A thickness of the ceramic elements 104 may vary depending on an intended application. For example, for some ballistic applications, the ceramic elements 104 may be between about 0.5 inches and about 2 inches. However, in other embodiments, the ceramic elements 104 may be thinner or thicker.

FIG. 2 illustrates another embodiment a composite component 200 for use in ballistic armor for vehicle 100. As shown in a side view, composite component 200 includes one or more ceramic elements 104 arranged in an adjacent manner. In this specific example of composite component 200, the ceramic elements 104 are arranged in the same plane. However the ceramic elements may also be arranged in a subjacent manner. As shown again in top view 112, the ceramic elements 104, in this example, may be arranged in pentagonal configuration. Also, in top view 208, multiple ceramic elements 104 are arranged in an adjacent manner where each ceramic element is encapsulated by a metal alloy 106. In this specific example, the ceramic elements are arranged to minimize the space between adjacent ceramic elements. However, the ceramic elements 104 may also be arranged in different orientations with respect to each other. In another specific example (not illustrated), the ceramic elements 104 may be arranged to facilitate anchor points that may be used to secure the composite component 200 to a vehicle 100.

FIG. 3 illustrates yet another embodiment of a composite component 300 usable for ballistic composite armor for vehicle 100. As shown in a side view, composite component 300 includes one or more ceramic elements 104 arranged in an overlapping manner. In this specific example of composite component 300, the ceramic elements 104 are arranged such that any gaps between the ceramic elements 104 are minimized or non-existent. For instance, the composite component 300 includes continuous surface area portions of the composite component 300 that are completely covered by or include ceramic material that are encapsulated by a metal layer. In one specific example, a portion of the composite component 300 comprises a portion free of gaps between the ceramic elements 104, a gap being any volume of composite component 300 which would enable a projectile to penetrate completely through the composite component 300 without impacting a ceramic element 104. The overlapping of the ceramic elements 104 may be accomplished in a variety of ways.

Figure 4:
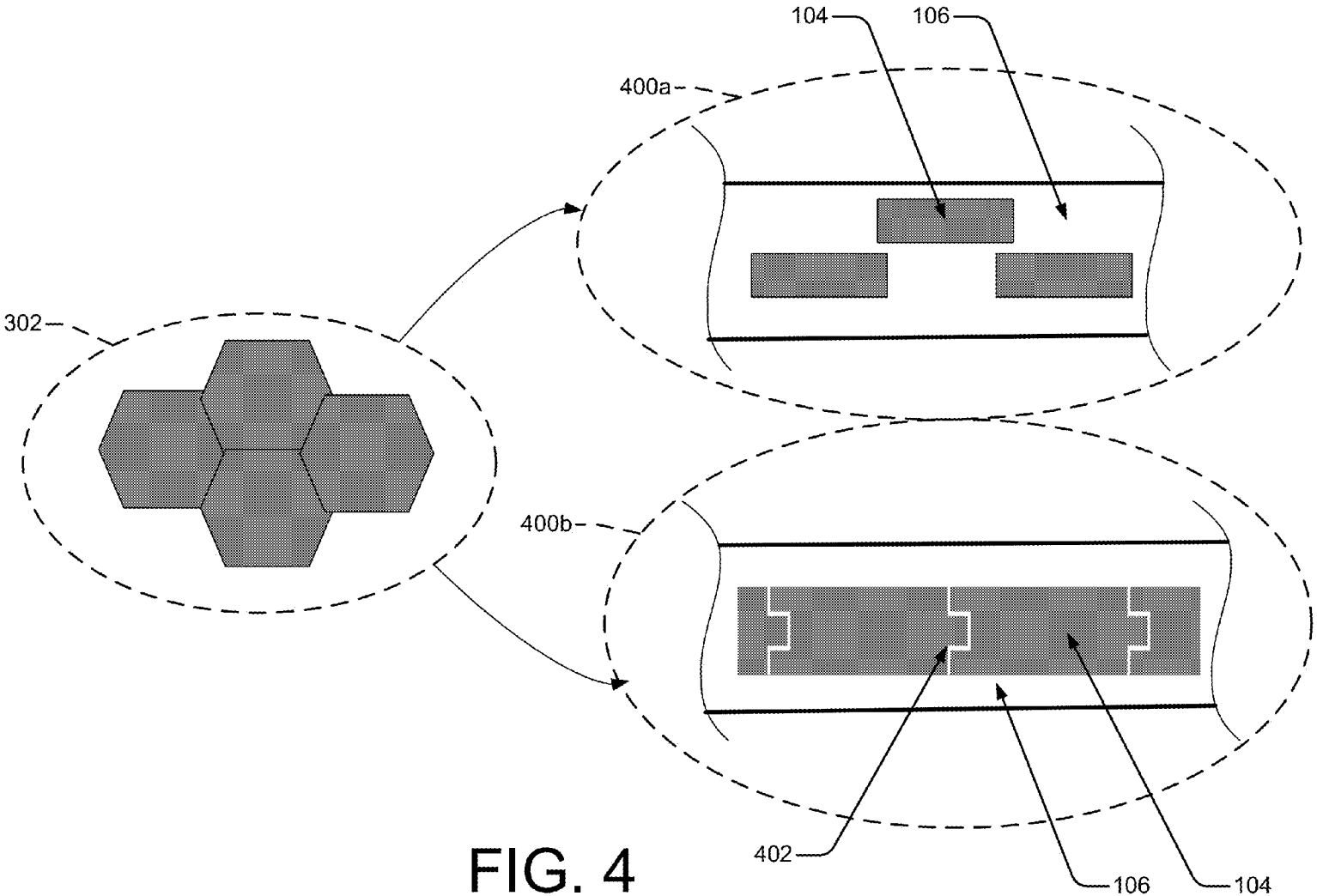
FIG. 4 is a schematic diagram illustrating a top view and side view of one of the embodiments for the composite ballistic armor.

FIG. 4 provides exemplary embodiments related to the arrangement of ceramic elements 104 in view of the gap-free embodiment described in FIG. 3. Top view 302 illustrates one example in which the ceramic elements 104 are arranged to minimize the gaps between ceramic elements. Illustrations 400*a* and 400*b* provide diagrams of exemplary side views of gap-free arrangements of ceramic elements 104.

In one example, Illustration 400*a* shows one possible subjacent arrangement of ceramic materials 104 that are encapsulated by a metal alloy 106. As shown in this specific example, the metal layer 106 separates each ceramic element from each other. This separation may be accomplished during the forming of the metal layer 106. For instance, the metal layer permeates the spaces or air gaps between the ceramic elements 104. Spacers placed between ceramic elements prior to the pouring process may create the separation between the ceramic elements 104. However, in another embodiment (not illustrated), the subjacent ceramic elements 104 may be in physical contact with each other.

In another example, illustration 400*b* shows one possible interlocking arrangement of ceramic materials 104 that are encapsulated by a metal alloy 106. In this instance, the ceramic elements 104 are configured with features or geometries that enable the ceramic elements to be interlocked or secured to each other. For example, the interlocking bevel 402 secures the ceramic elements to each other and provides continuous ceramic ballistic protection over a portion of the composite component 300.

Example Methods of Forming Composite Armor Components

Many distinct materials may be combined to form components or even new materials that provide unique performance characteristics that the materials by themselves would be unable to achieve. In some instances, the materials themselves may not lend themselves to being combined with other elements, or moreover, the combination of materials may not be able to achieve desired characteristics using known methods. Hence, new methods that enable the combination of new materials or achieve long sought materials characteristics are extremely desirable. For example, being able to combine hard ceramic materials with tough armor rated metals to achieve maximum ballistic protection while minimizing weight and cost is highly desirable.

Figure 5:
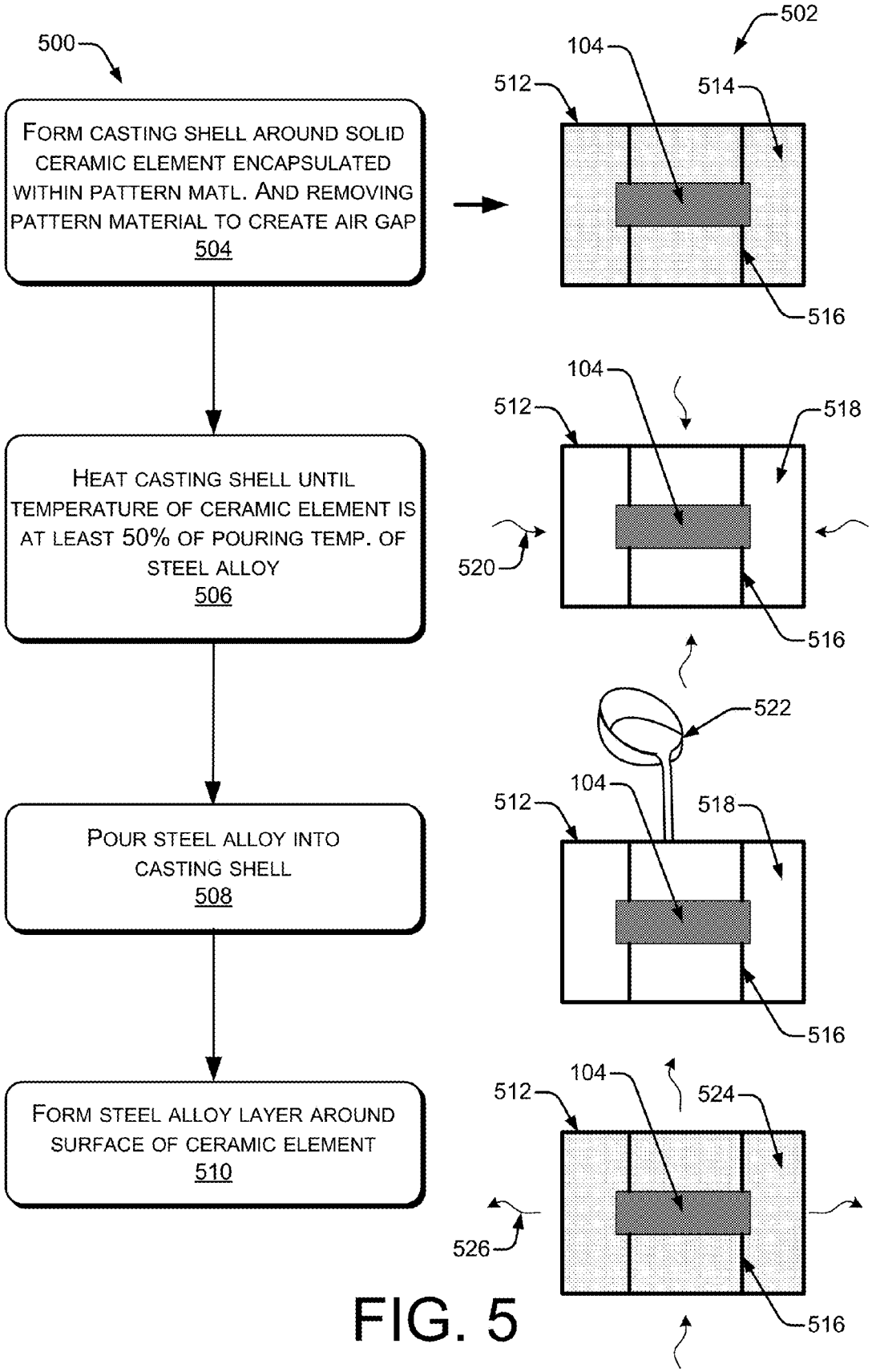
FIG. 5 is a flow diagram illustrating an example process of casting a composite ballistic armor alongside corresponding schematic diagrams illustrating the acts being described in the flow diagram.

FIG. 5 illustrates an exemplary flow diagram 500 for a method of creating a composite component 300 that includes a ceramic element 104 encapsulated by a metal layer 106. Accompanying flow diagram 500 is a set of exemplary illustrations 502 of the acts comprising the method described by flow diagram 500.

At act 504, a ceramic element 104 is encapsulated in a pattern material 514, which is then coated or encapsulated in a casting shell 512. The casting shell 512 may be comprised of, for example, zircon and fused silica. For example, the shell may be comprised of 75% zircon and multiple coats of fused silica. The casting shell 512 may be comprised of any material or combination of materials able to withstand the temperatures and forces of casting. For example, in some implementations, the casting shell 512 may be configured to withstand temperatures up to 3500 degrees F. Also, a plurality of screws or pins 516 or any other coupling device that may secure the ceramic element 104 to the casting shell 512. In another embodiment, the ceramic element 104 may include a plurality of ceramic elements that may be located adjacent or subjacent to each other as illustrated in diagram 400*a*. Additionally, the plurality of ceramic elements 104 may also be in physical contact with each other as illustrated in diagram 400*b*. In another embodiment, a preformed casting shell may be placed around the ceramic element. In this specific example, the pattern material may not be used and the ceramic element may be secured to the preformed casting shell via screws or any other coupling device. The preformed casting shell may be a single piece or multi-piece casting shell.

At act 506, an air gap 518 is created between the casting shell 512 and the ceramic element 104. In one example, the air gap 518 may be formed by heating the casting shell 512 to remove the pattern material 514. Next, the casting shell is heated by convective energy 520 or any other type of energy (e.g., conductive or radiation) to preheat the ceramic element 104 to a temperature of at least about 50% of the melting point or pouring temperature of the encapsulating metal 106. In the case of steel, for example, the ceramic element may be preheated to at least about 1300 degrees F. In some embodiments, the ceramic element 104 may be preheated to at least about 75% of the melting point or pouring temperature of the encapsulating metal 106 (e.g., at least about 1950 degrees F. for steel). In other embodiments, the ceramic element 104 may be preheated to at least the melting point or pouring temperature of the encapsulating metal 106 (e.g., at least about 2600 degrees F. for steel). In other embodiments, the ceramic element 104 may be superheated relative to the melting or pouring temperature of the encapsulating metal 106.

As noted above, it may take more time to heat the ceramic element to the desired preheat temperature than it takes to heat the casting shell to the desired preheat temperature. Thus, the casting shell may be soaked at the desired temperature for a time sufficient for the ceramic element inside the casting shell to reach the desired preheat temperature. Additionally or alternatively, the casting shell may be heated above the desired preheat temperature of the ceramic element, in order to shorten the time required for the ceramic element to reach the desired preheat temperature.

At act 508, a molten base metal (e.g., steel alloy) 522 is poured into the casting shell 512 and envelops the ceramic element 104. The base metal 522 may be any type of steel or metal that may be desirable for protection against ballistic impacts. In a specific example, the steel alloy may be steel alloy 4140 or 8630 under the American Iron and Steel Institute (AISI) standard. In other specific examples, the steel alloy may be a stainless steel alloy or FeMnAl.

At act 510, a metal layer 524 solidifies around the surface of the ceramic element 104 as energy or heat 526 dissipates from the casting shell 512. Once the cooling is complete, the composite component 300 may be removed from the casting shell 512. Also, the newly formed metal layer 524 may be machined to provide a desired thickness and/or geometry for metal layer 106 which ultimately encapsulates the ceramic element 104 of composite component 300.

Additionally, any number of post processes techniques maybe performed on the composite component 300, such as heat treatment (e.g., quenching, tempering, austempering, gradual cooling, forced cooling, cryogenic freezing), finishing (e.g., polishing, knurling, pinning, etc.) and/or application of surface treatments (e.g., paint, powder coating, etching, etc.).

Figure 6:
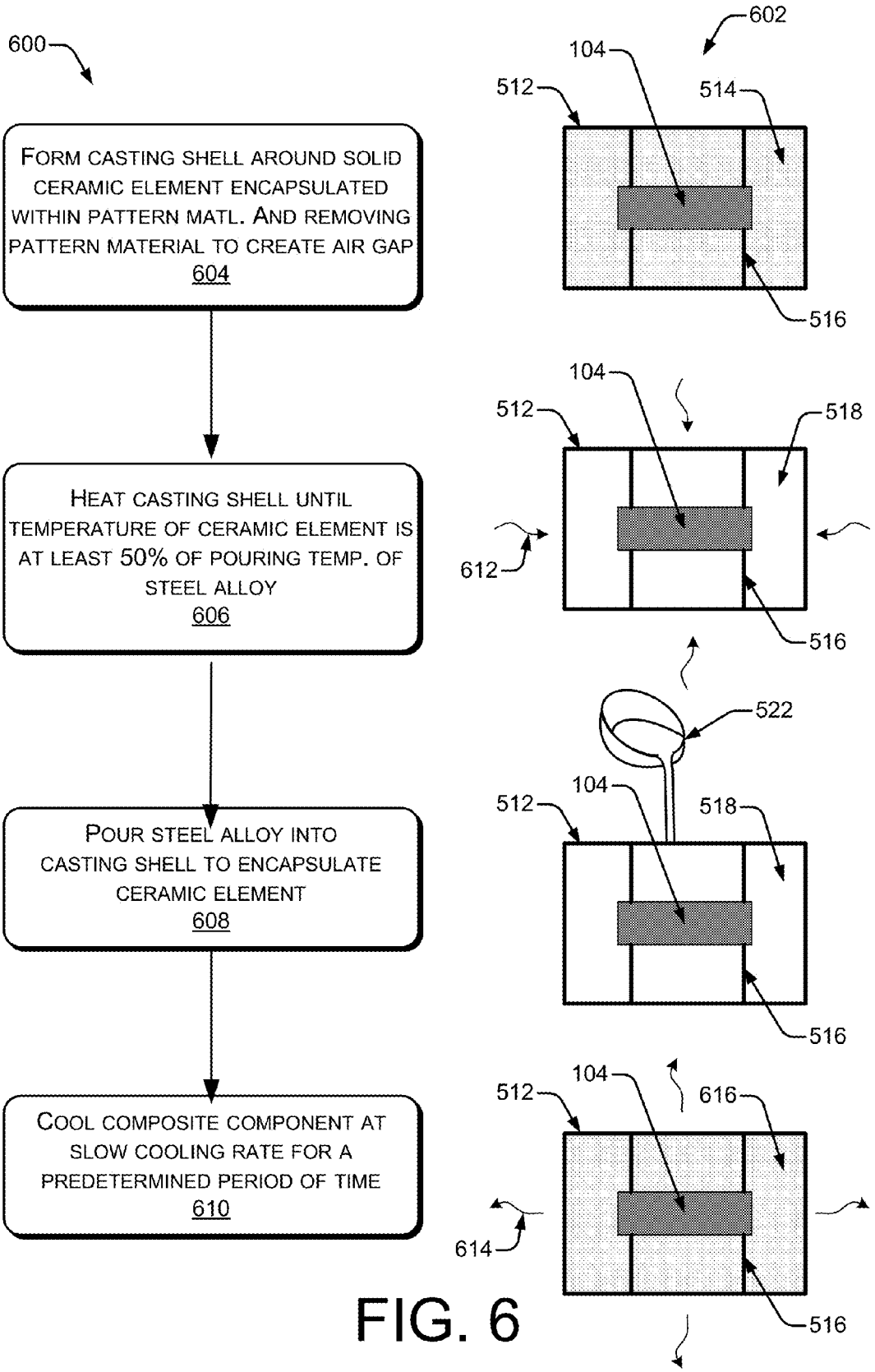
FIG. 6 is another flow diagram illustrating another example process of casting a composite ballistic armor alongside corresponding schematic diagrams illustrating the acts being described in the flow diagram.

FIG. 6 illustrates an exemplary flow diagram 600 for a method of creating a composite component 300 that includes a ceramic element 104 encapsulated by a metal layer 106. Accompanying flow diagram 600 is a set of exemplary illustrations 602 of the acts comprising the method described by flow diagram 600.

At act 604, a ceramic element 104 is encapsulated in a pattern material 514, which is then coated or encapsulated in a casting shell 512. The casting shell 512 may be comprised of, for example, zircon and fused silica. In one specific example, the shell may be comprised of 75% zircon and multiple coats of fused silica. The casting shell 512 may be comprised of any material or combination of materials able to withstand the temperatures and forces of casting. For example, in some implementations, the casting shell 512 may be configured to withstand temperatures up to 3500 degrees F. Also, a plurality of screws, pins 516, or any other coupling device that may secure the ceramic element 104 to the casting shell 512. In another embodiment, the ceramic element 104 may include a plurality of ceramic elements that may be located adjacent or subjacent to each other as illustrated in diagram 400*a*. Additionally, the plurality of ceramic elements may also be in physical contact with each other as illustrated in diagram 400*b*.

At act 606, an air gap 518 is created between the casting shell 512 and the ceramic element 104. In one example, the air gap 518 may be formed by heating the casting shell 512 to remove the pattern material 514. Next, the casting shell is heated by convective energy 520 or any other type of energy (e.g., conductive or radiation) to preheat the ceramic element 104 to a temperature of at least about 50% of the melting point or pouring temperature of the encapsulating metal 106. In the case of steel, for example, the ceramic element may be preheated to at least about 1300 degrees F. In some embodiments, the ceramic element 104 may be preheated to at least about 75% of the melting point or pouring temperature of the encapsulating metal 106 (e.g., at least about 1950 degrees F. for steel). In other embodiments, the ceramic element 104 may be preheated to at least the melting point or pouring temperature of the encapsulating metal 106 (e.g., at least about 2600 degrees F. for steel). In other embodiments, the ceramic element 104 may be superheated relative to the melting or pouring temperature of the encapsulating metal 106.

Again, the casting shell may be soaked at the desired temperature for a time sufficient for the ceramic element inside the casting shell to reach the desired preheat temperature. Additionally or alternatively, the casting shell may be heated above the desired preheat temperature of the ceramic element, in order to shorten the time required for the ceramic element to reach the desired preheat temperature.

At act 608, a molten steel alloy 522 is poured into the casting shell 512 and envelops the ceramic element 104. The steel alloy 522 may be any type of steel or metal that may be desirable for protection against ballistic impacts. The steel alloy may be, for example, steel alloy 4140 or 8630 AISI, a stainless steel alloy, or FeMnAl.

At act 610, a metal layer 616 solidifies around the surface of the ceramic element 104 as energy or heat 614 dissipates from the casting shell at a relatively slow cooling rate for a predetermined period of time in a temperature controlled environment (e.g., a cooling tunnel, furnace, or the like). The controlled cooling may be implemented by decreasing the amount of energy 612 being exposed to the casting shell. Alternatively, the casting shell may be allowed to cool in a temperature controlled environment that limits the cooling rate without introducing outside energy or heat. The cooling rate and the predetermined period of time may be any of those described in this application.

Once the cooling is complete, the composite component 300 may be removed from the casting shell 506. Also, the metal layer 616 may be machined to provide a desired thickness for metal layer 106 which ultimately encapsulates the ceramic element 104 of composite component 300.

In other embodiments, different casting techniques may in addition to the investment casting process described above. The other casting techniques may include sand casting, die casting, or any other type of shell or mold casting.

CONCLUSION

Although the disclosure uses language specific to structural features and/or methodological acts, the claims are not limited to the specific features or acts described. Rather, the specific features and acts are disclosed as illustrative forms of implementing the invention. For example, the various embodiments described herein may be rearranged, modified, and/or combined. As another example, one or more of the method acts may be performed in different orders, combined, and/or omitted entirely, depending on the composite component to be produced.

What is claimed is:

1. A method comprising:

forming or placing a casting shell around a solid ceramic tile, the casting shell being used to encapsulate the solid ceramic tile with a steel alloy, the casting shell including an air gap between the casting shell and the solid ceramic tile;

preheating the casting shell until a temperature of the solid ceramic tile inside the casting shell is at least about 50% of a pouring temperature of the steel alloy;

pouring the steel alloy into the casting shell; and forming a steel alloy layer around the surface of the solid ceramic tile.

2. The method of claim 1, wherein the solid ceramic tile comprises alumina and/or silicon carbide.

3. The method of claim 1, wherein the pouring temperature of the steel alloy is between about 2500 degrees Fahrenheit (F) and about 3200 F.

4. The method of claim 1, wherein the solid ceramic tile comprises a triangle shape, square shape, pentagonal shape, hexagonal shape, or octagonal shape.

5. The method of claim 1, wherein the solid ceramic tile comprises a polygonal or curvilinear shape.

6. The method of claim 1, further comprising one or more additional solid ceramic tiles disposed in the casting shell, the solid ceramic tile and the additional solid ceramic tiles collectively comprising multiple solid ceramic tiles.

7. The method of claim 6, wherein the multiple solid ceramic tiles are arranged substantially adjacent to one another.

8. The method of claim 6, wherein the multiple solid ceramic tiles are arranged with at least some of the multiple solid ceramic tiles being subjacent to others of the multiple solid ceramic tiles.

9. The method of claim 6, wherein the multiple solid ceramic tiles are arranged in an overlapping manner.

10. The method of claim 1, wherein the steel alloy comprises 4140 or 8630 AISI steel.

11. The method of claim 1, wherein the steel alloy comprises FeMnAl.

12. The method of claim 1, wherein forming the casting shell further comprises:

coupling a plurality of coupling devices to the solid ceramic tile;

encapsulating the solid ceramic tile in a pattern material;

encapsulating the pattern material with the casting shell;

coupling the coupling devices to the casting shell; and heating the casting shell to remove the pattern material from inside the casting shell to create the air gap between the casting shell and the solid ceramic tile.

13. A method comprising:

forming a casting shell around a solid ceramic element, the casting shell including an air gap between the casting shell and the solid ceramic element, the forming comprising:

coupling a plurality of coupling devices to the solid ceramic element;

encapsulating the solid ceramic element in a pattern material;

encapsulating the pattern material with the casting shell;

coupling the coupling devices to the casting shell; and heating the casting shell to remove the pattern material from inside the casting shell to create the air gap between the casting shell and the solid ceramic element;

preheating the casting shell until a temperature of the solid ceramic element inside the casting shell has a uniform temperature of at least about 50% of a pouring temperature of a steel alloy;

pouring the steel alloy into the casting shell; and cooling the casting shell at a rate of at most 200 degrees Fahrenheit (F) per hour for a predetermined period of time.

14. The method of claim 13, wherein preheating the solid ceramic element comprises preheating the ceramic element to at least about 75% of the pouring temperature of the steel alloy.

15. The method of claim 13, wherein the solid ceramic element is arranged as a triangle shape, square shape, pentagonal shape, hexagonal shape, or octagonal shape.

16. The method of claim 13, wherein the solid ceramic element comprises at least three or more substantially vertical sides and at least two parallel horizontal sides.

17. The method of claim 13, wherein the steel alloy comprises 4140 or 8630 AISI steel.

18. The method of claim 13, wherein the steel alloy comprises FeMnAl.

19. The method of claim 13, wherein the casting shell comprises a combination of at least zircon and fused silica.

20. The method of claim 13, wherein the cooling comprises placing the casting shell in a temperature controlled environment.

21. A method comprising:

forming a casting shell around a solid ceramic element, the forming comprising:

encapsulating the solid ceramic element in a pattern material;

encapsulating the pattern material with the casting shell; and heating the casting shell to remove the pattern material from inside the casting shell to create an air gap between the casting shell and the solid ceramic element;

preheating the casting shell until a temperature of the solid ceramic element inside the casting shell has a uniform temperature of at least about 50% of a pouring temperature of a steel alloy;

pouring the steel alloy into the casting shell; and cooling the casting shell at a rate of at most 200 degrees Fahrenheit (F) per hour for a predetermined period of time.

* * * * *